US006702982B1

(12) United States Patent
Chin et al.

(10) Patent No.: US 6,702,982 B1
(45) Date of Patent: Mar. 9, 2004

(54) ALUMINUM-LITHIUM ALLOY

(75) Inventors: Ernest S. C. Chin, Burlington, MA (US); Euriqua Lavernia, Irvine, CA (US)

(73) Assignees: The United States of America as represented by the Secretary of the Army, Washington, DC (US); The Regents of the University of California, Oakland, CA (US)

( * ) Notice: Subject to any disclaimer, the term of this patent is extended or adjusted under 35 U.S.C. 154(b) by 0 days.

(21) Appl. No.: 08/396,386

(22) Filed: Feb. 28, 1995

(51) Int. Cl.[7] ..... C22C 21/00
(52) U.S. Cl. ..... 420/552; 420/528; 148/437
(58) Field of Search ..... 420/528, 552; 148/437

(56) References Cited

U.S. PATENT DOCUMENTS

| | | | | | |
|---|---|---|---|---|---|
| 4,738,389 | A | * | 4/1988 | Moshier et al. | 228/198 |
| 4,751,048 | A | * | 6/1988 | Christodoulou et al. | 420/129 |
| 4,915,903 | A | * | 4/1990 | Brupbacher et al. | 420/129 |
| 4,916,029 | A | * | 4/1990 | Nagle et al. | 428/614 |
| 4,916,030 | A | * | 4/1990 | Christodoulou et al. | 428/614 |
| 4,917,964 | A | * | 4/1990 | Moshier et al. | 428/614 |

* cited by examiner

*Primary Examiner*—M. Alexandra Elve
(74) *Attorney, Agent, or Firm*—Muzio B. Roberto; U. John Biffoni; William V. Adams

(57) ABSTRACT

A method for mixing an in-situ aluminum matrix composite with an aluminum-litium alloy via the spray deposition process to obtain an Al—Li composite.

1 Claim, 2 Drawing Sheets

ALUMINUM-LITHIUM ALLOY

RIGHTS OF THE GOVERNMENT

The invention described herein may be manufactured, used and licensed by or for the Government for Government purposes without the payment to us of any royalties thereon,

BACKGROUND OF THE INVENTION

Technical Field

The present invention provides an aluminum—lithium titanium carbide alloy composite material, and comprises a method of mixing an in—situ aluminum matrix composite and an aluminum lithium alloy via a spray deposition process to obtain an aluminum lithium matrix composite.

BACKGROUND INFORMATION

For high temperature aerospace applications, Ti alloys are often used to produce structural parts, However the costs have often been the drawback. Finding an alternative has motivated the development of advanced aluminum alloys to satisfy the requirement of Ti alloys.

Among the aluminum systems developed over the decades, the aluminum transitional element family has so far given the most promising properties. With improvement in processing techniques and conditions, these dispersions—strengthened aluminum alloys exhibit strength up to 600 MPa. 17% elongation and fracture toughness of 25 MPa( at room temperature and retain strength of 300 MPa up to 315 Centigrade.

A new class of elevated—temperature aluminum based materials is being developed by incorporating the concept of metal matrix compounds (MMC) into designs. It has been shown by introducing the matrix with ceramic particles, the strength of the MMC is increased by as much as 100 MPAs over the monolithic counterpart. Work is continuing on advancing MMCs with the properties of the existing elevated—temperature materials to produce high strength, better thermomechanical response composites.

DESCRIPTION OF THE INVENTION

This invention provides the processing means by which monostructural requirements are obtained in producing a lighted material with superior ballistic protection compared to that of conventional aluminum armor alloys. Conventional aluminum alloys are a strain hardened material processed through direct chilled casting followed by warm and cold rolling. The ballistic performance of the alloys improves with increasing yield strength. Armor strength is limited by the lack of workability with increasingly hardness.

Aluminum -lithium alloys are developed as a lightweight replacement for conventional high strength aerospace aluminum alloys. Addition of lithium to aluminum lowers the density, and enhances stiffness and strength of the aluminum alloy. Ballistic performance of the aluminum—lithium is limited by delamination and spall due to impurities along highly delineated fibrous grains developed from processing.

The present invention circumvents the aforementioned difficulties via processing. The present method provides for the mixing of an in—situ particulate reinforced aluminum and an aluminum—lithium alloy. The in—situ particulate reinforced aluminum alloy may be process from prolonged precipitation in a heavily alloyed molten aluminum melt or by other proprietary method. The main criteria for the in—situ composite is that it contain thermodynamically stable sub—micron reinforcements.

OBJECTS OF THE INVENTION

It is an object of the present invention to provide and disclose a light weight, lithium containing aluminum composite having superior ballistic properties.

It is an object of the invention to provide and disclose a light weight lithium aluminum composite having an ultra fine grain size.

It is a further object of the invention to provide and disclose a method for mixing in—situ of the aluminum matrix composite with aluminum—lithium via spray deposition process to obtain an Al—TiC matrix composite Other object and a fuller understanding of the invention may be ascertained from the following description, drawings and claims.

PREFERRED EMBODIMENT

Figure 1:
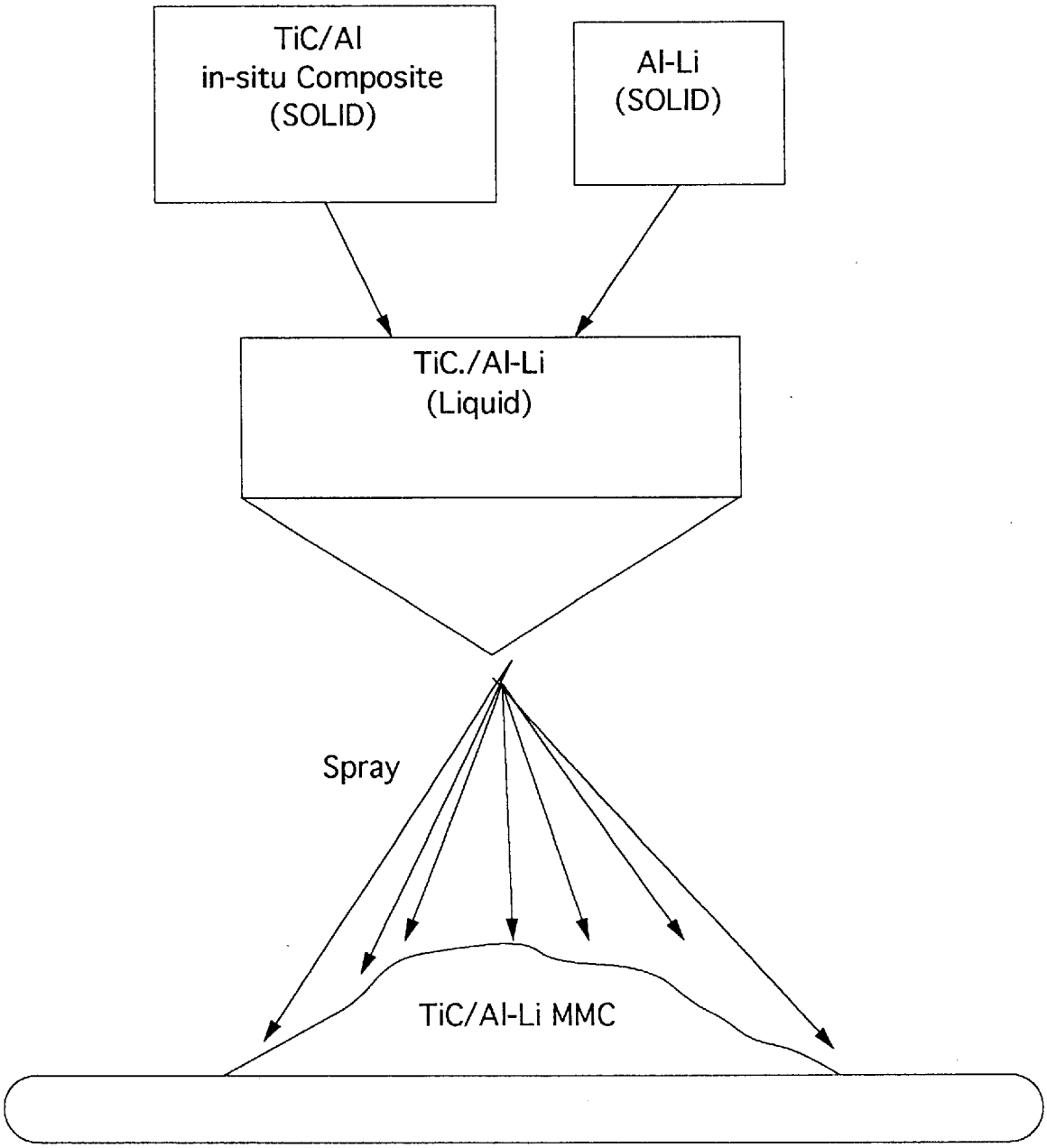
FIG. 1 is a schematic illustration of the deposition and spray technique used to carry out the invention.
Figure 2:
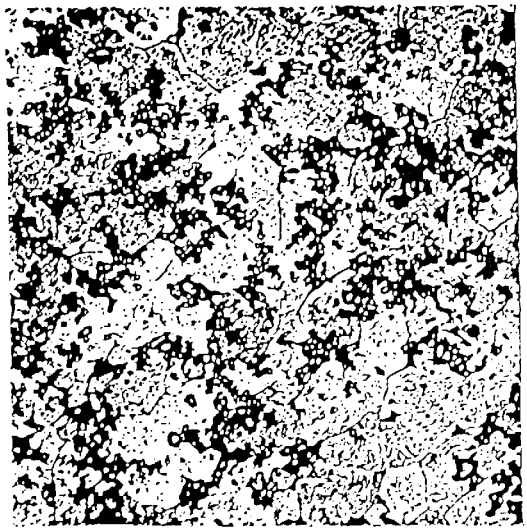
FIG. 2 is black and white photograph of the Al—Li/TiC particles as received.
Figure 3:
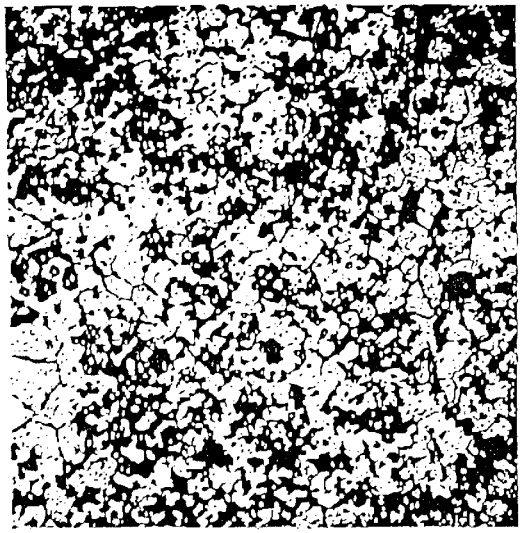
FIG. 3 is a black and white photograph of the Al—Ti/TiC particles in sprayed ingot form/

Approximately, 1.3 kg of 2014 Al and 10% by weight titanium carbide particles were placed in a ceramic crucible with 16 grams lithium, and heated in an environmental atmosphere to avoid oxidation. The mixture was heated to 800 degrees Centigrade, spray atomized with an inert gas (nitrogen) at a pressure of 1.2 MPa and a flow rate of 15.56 g/sec, at a flight distance of 43.64 cm to produce a fine stream of partially solidified droplets. The droplets were deposited on a water cooled substrate, and rapidly quenched on impact.

Following the atomization, the microstructure characterization of the composite was conducted to determine grain size and density of the sprayed deposited material. The spray deposit exhibited an equiaxed grain morphology with an associated grain size of 12.7 $\mu$m, and an average density of 2.84 g/cm$^3$, which corresponds to approximately 87% of the ingot metal material.

Although we have described our invention with a certain degree of particularity, it is understood that modifications may be made without departing from the spirit and scope of the invention.

Having described our invention we claim:

1. A composition of matter consisting essentially of aluminum-lithium/titanium carbide particles having a grain size of 12.7 $\mu$m and a density of 2.84 g/cm$^3$ being formed by:

positioning 1.3 kg of aluminum, 10% by weight of titanium carbide particles, and 16 grams of lithium in a ceramic chamber;

superheating the mixture to 800 degrees Centigrade;

spray-atomizing the mixture at a pressure of 1.2 MPa to form;

rapidly quenching the droplets by impacting on a water-cooled substrate to form uniform, coherent preform, and recovering the product.

* * * * *